United States Patent [19]

LaBudde et al.

[11] Patent Number: 4,799,429

[45] Date of Patent: Jan. 24, 1989

[54] PROGRAMMING CIRCUIT FOR INDIVIDUAL BOMBLETS IN A CLUSTER BOMB

[75] Inventors: Edward V. LaBudde, Newbury Park; Robert L. Kay, Calabasas, both of Calif.

[73] Assignee: ISC Technologies, Inc., Lancaster, Pa.

[21] Appl. No.: 595,256

[22] Filed: Mar. 30, 1984

[51] Int. Cl.[4] ..... F42B 25/16; F42C 11/06

[52] U.S. Cl. ..... 102/393; 102/206; 102/396; 102/489

[58] Field of Search ..... 102/393, 396, 489, 206, 102/215; 89/6, 6.5

[56] References Cited

U.S. PATENT DOCUMENTS

| | | | |
|---|---|---|---|
| 2,348,240 | 5/1944 | Braun | 102/393 |
| 2,972,946 | 2/1961 | Poulter | 102/393 |
| 3,980,019 | 9/1976 | Anderson et al. | 102/393 |
| 4,125,310 | 11/1978 | Reardon, II et al. | 339/92 |
| 4,172,407 | 10/1979 | Wentink | 102/393 |
| 4,178,851 | 12/1979 | Brady | 102/393 |
| 4,372,216 | 2/1983 | Pinson et al. | 102/393 |
| 4,454,815 | 6/1984 | Beck | 102/206 |
| 4,495,851 | 1/1985 | Koerner et al. | 89/6.5 |
| 4,638,736 | 1/1987 | Farmer | 102/393 |
| 4,724,766 | 2/1988 | LaBudde | 102/393 |

OTHER PUBLICATIONS

Hughes Gold Dot Interconnection System Advertisement.

*Primary Examiner*—Charles T. Jordan

*Attorney, Agent, or Firm*—Koppel & Jacobs

[57] ABSTRACT

A bomblet within a cluster bomb is provided with an individually programmable detonation time delay, such that the bomblet can be programmed to detonate at a desired time after it has been dropped. Program signals are transmitted to the bomblet from a wire that runs through an opening in the bomblet, but is not mechanically attached to the bomblet. the bomblet has a secondary transformer winding to receive signals from the transmission wire, and is provided with a unique address code such that it responds to a timing program signal only when the signal is preceded by an appropriate address code. A series of timing program signals can be transmitted to a plurality of bomblets, with the bomblet addresses adjusted after each program signal so that only one bomblet (or more, if desired) responds to each successive program signal.

21 Claims, 4 Drawing Sheets

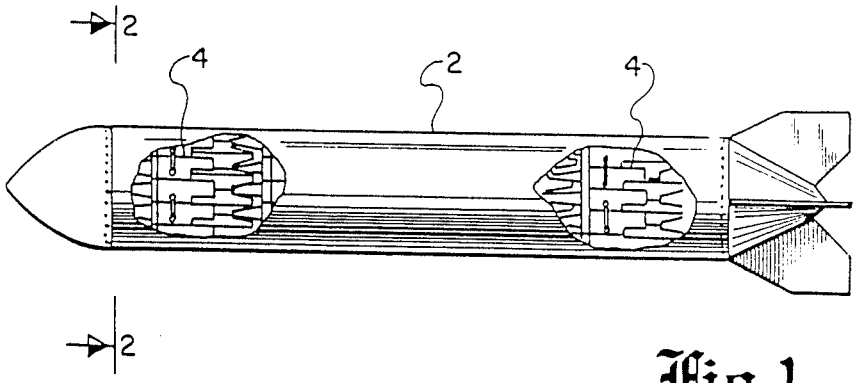
Fig.1.
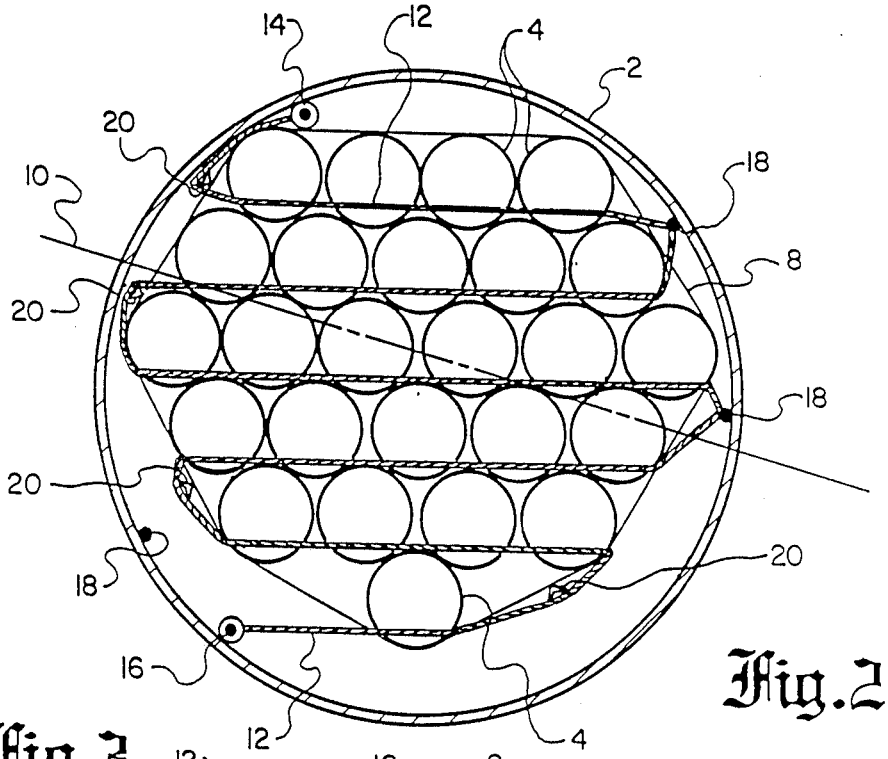
Fig.2.
Fig.3.
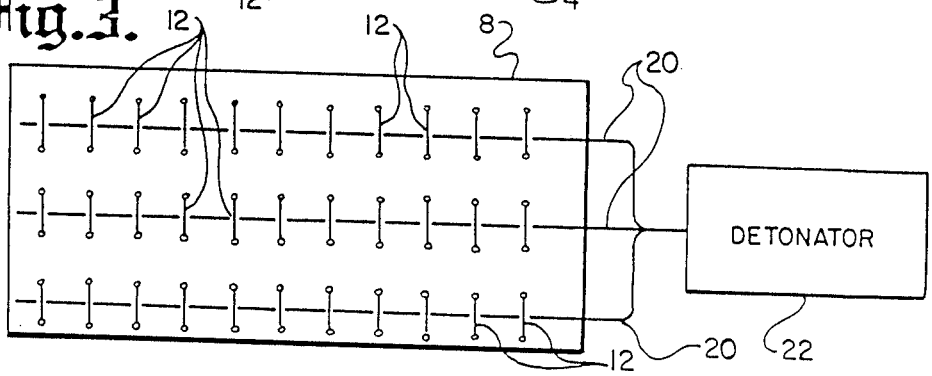

PROGRAMMING CIRCUIT FOR INDIVIDUAL BOMBLETS IN A CLUSTER BOMB

BACKGROUND OF THE INVENTION

1. Field of the Invention

This invention relates to cluster bombs, and more particularly to a detonator control circuit for the individual bomblets carried within a cluster bomb.

2. Description of the Prior Art

Cluster bombs have been used for some time to provide area coverage from a single bomb drop. Up to several hundred bomblets are carried within a single outer housing or canister, which separates into two parts when dropped from an aircraft and releases the bomblets. The individual bomblets ideally fall in a predetermined dispersion pattern to cover a large area. Some cluster bombs have no facilities for communicating with individual bomblets, and the bomblets explode upon impact or after a built-in delay period. In a more sophisticated type of cluster bomb, each of the individual bomblets is connected to a central controller by means of a wire harness, with separate cables running from the harness to each individual bomblet. The use of such cables makes it possible to communicate with the bomblets after they have been positioned in the bomb canister, for purposes such as arming the bomblets or providing a common detonation delay time to each of the bomblets.

While the use of such wire harness connections provides greater versatility in the applications for which the cluster bomb may be used, it also limits the performance of the bomb. It is generally desirable that the bomblet dispersion pattern be homogeneous over a large area. The forces acting on the bomblets as they are released from the cluster bomb are critical in determining the dispersion pattern, with only a few ounces of force on each bomblet being sufficient to greatly distort the pattern. One probe with the prior art wire harness approach has been that, in order to provide communication with the bomblets, the wire harnesses have had their cables mechanically connected directly to each bomblet. When the bomblets are released, they must then be disconnected from their respective cables in order to fall freely. Various attempts have been made to disconnect the bomblets without adversely effecting their dispersion pattern, but none have been entirely successful.

In addition to the separation problems mentioned above, the wire harness approach is quite expensive, in large part because it requires a separate cable for each of typically several hundred bomblets. Furthermore, none of the prior art cluster bombs have a capability, after the bomblets have been packaged within the bomb canister, of programming each of the bomblets with individual detonation delay times. Such a capability would be desirable in order to have the bomblets detonate at predetermined time intervals over a large ground area, and thus deny the area to an opposing force for the period that the bomblets continue to detonate.

In a companion U.S. patent application by Edward V. LaBudde, Ser. No. 590,215, filed Mar. 16, 1984, now Pat. No. 4,724,766, and entitled "Cluster Bomb System and Method", a new type of cluster bomb is described in which each of the bomblets is provided with an individual programmable detonator control. A signal transmission means electromagnetically transmits program information signals to the vicinity of each bomblet, while an electromagnetic signal coupler within each bomblet provides an interface between the transmission means and the detonator control to program the detonator control in response to program information signals delivered by the transmission means. In the preferred embodiment the signal transmission means is an electrically conductive wire positioned adjacent to but mechanically detached from, each of the bomblets. The wire serves as a primary transformer winding, each bomblet being provided with a multi-turn secondary winding to receive signals from the wire. The wire preferably extends through an opening in each bomblet, with the secondary windings disposed around the periphery of the openings. In order to rapidly pull the wire away when the bomb canister opens without imparting any significant force to the bomblets, the wire is mechanically attached to the canister at selected locations, and the canister is adapted upon opening to sever the wire and pull it away from the bomblets.

The detonator control for each bomblet includes an address code storage means for storing an address code which is unique for that bomblet, thereby enabling each bomblet to be individually accessed from the transmission wire by the transmission of an appropriate address code. In the preferred embodiment the address codes for the various bomblets are arranged in sequence. Means are provided to access the address codes stored in each bomblet in response to an actuating signal from the transmission wire, such that the bomblets sequentially detect a predetermined address code in response to successive actuating signals. In this manner the bomblets can be individually accessed in sequence by the repeated transmission of a single address code.

The detonator control for each bomblet further includes a timer which activates the bomblet's detonating mechanism after a delay period established by the timer. The timer is connected to receive a timing delay signal from the transmission wire when its respective bomblet is addressed. Each of the bomblets is programmed with an individual detonation time delay by repeatedly transmitting a predetermined address code, adjusting the address code stored in each bomblet with each transmission so that a different bomblet is accessed with each transmission, and alternating the address code transmissions with desired time delay program signals. In this manner, each bomblet in turn is accessed and programmed with an individual detonation time delay. Each bomblet also includes a mechanism which is responsive to the bomblet being released from the bomb canister for actuating the detonator timer to begin a detonation timing cycle, as determined by the delay programmed into the particular bomblet.

The LaBudde patent application also describes the use of an initiation signal to initially clear the timer and establish an initial address count for each bomblet. The initiating, address count and time delay program signals are in the form of pulses of varying width, and each bomblet is provided with pulse width discrimination circuitry for distinguishing between the various signals.

SUMMARY OF THE INVENTION

The present invention is for a novel and improved detonator control circuit for the bomblets in a cluster bomb of the type claimed in the LaBudde patent application, the present invention having been described in that application as a preferred implementation.

The object of the present application is the provision of a novel and improved detonator control circuit for the bomblets of a cluster bomb in which each bomblet includes a detonation mechanism and a transformer secondary winding for receiving bomblet address and detonation delay signals.

In the accomplishment of this object, each cluster bomblet is provided with an address storage means in which an adjustable bomblet address is stored. A programmable timing means is connected to actuate the bomblet's detonating mechanism after a programmed time delay. Bomblet address signals on the secondary winding are recognized by a signal discriminator circuit, which is connected to the address storage means to adjust the address stored therein in response to the discriminator circuit receiving a bomblet address signal. The secondary winding is connected to transmit a detonation delay program signal to the timing means. An enabling circuit enables programming of the timing means by a detonation delay signal when the address stored in the address storage means has been adjusted to a predetermined address, but disables programming of the timing means at other times.

In a preferred embodiment the address storage means consists of a permanent storage means supplied with a permanent address, and a buffer storage means to which the permanent address is transferred when an initiation signal is received. The address held in the buffer storage means is adjusted each time the discriminator circuit receives a bomblet address signal. The initiation, bomblet address and detonation delay signals are preferably pulse signals of mutually exclusive durations.

In the preferred embodiment the timing means comprises a counter which counts up to a number determined by the duration of the detonation delay signal, an oscillator which causes the counter to progressively count down at a predetermined and much slower rate beginning when the bomblet enters a drop sequence, and means for actuating the detonator when the counter has counted down to a predetermined number. The upcount is controlled by a switch which is exercised by the AC detonation delay signal, causing the counter to count up at a rate corresponding to the switch exercise rate.

The detonator control circuitry is powered by a rectifier circuit connected to the secondary winding. An internal battery powers the circuitry after the bomblet has been released and armed, while a capacitor circuit charged by the rectifier circuit supplies power during the interval after the primary winding has been pulled away and before the battery has been connected into the circuit.

These and other objects of the invention will be apparent to those skilled in the art from the ensuing description of preferred embodiments, taken together with the accompanying drawings, in which:

DESCRIPTION OF THE DRAWINGS

FIG. 1 is a partially cutaway plan view of a cluster bomb constructed in accordance with the invention;

FIG. 2 is a sectional view taken along the lines 2-2 of FIG.1, showing the relative disposition of bomblets stacked within the cluster bomb, and the transmission wire used to communicate with the bomblets;

FIG. 3 is a somewhat diagrammatic plan view of the outside of a dunnage bag which holds the bomblets within the bomb canister, showing exposed portions of the transmission wire and a detonator cord used to cut the wire;

FIG. 6 is a sectional view taken along the lines 6-6 of FIG. 5;

FIG. 10 is a schematic diagram of the detonation control system for each bomblet.

DETAILED DESCRIPTION OF PREFERRED EMBODIMENTS

Figures 4, 5:
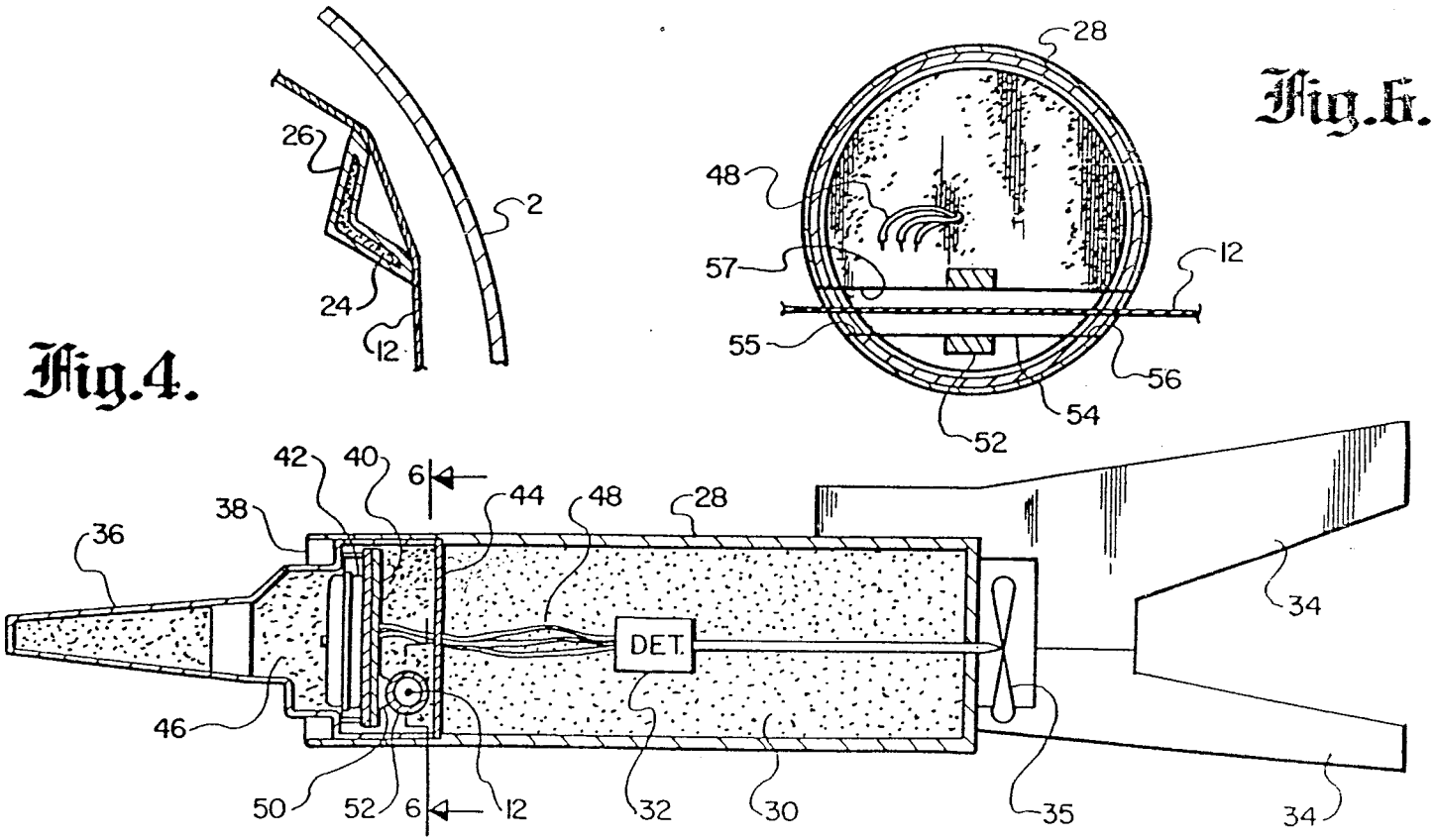
FIG. 4 is a fragmentary sectional view showing the transmission wire and the detonator cord used to cut the wire.
FIG. 5 is a sectional view of a bomblet constructed in accordance with the invention.

Referring first to FIG. 1, a cluster bomb employing the concepts of the present invention is shown. The bomb consists of an outer housing or canister 2 which separates into two halves in a conventional manner upon being dropped from an aircraft. Within the bomb are multiple ranks of bomblets 4 which are stacked in tight packs so that up to several hundred bomblets can be packaged within the outer canister.

A cross-sectional view of one of the stacks of bomblets is illustrated in FIG. 2. The bomblets 4 are stacked so that they generally conform to the shape of the canister 2, with a foam dunnage bag 8 enclosing the bomblets and separating them from the canister wall. The axis of separation along which the bomb canister divides into two longitudinal halves when dropped from an aircraft, permitting the bomblets to be released from the canister and dunnage bag and dispersed over an area, is shown by dashed line 10.

A transmission wire 12, which enables communication with and individual programming of each of the bomblets, is wound through the interior of the canister in a serpentine fashion, in and out of the dunnage bag, so that it passes adjacent to each of the bomblets in the stack. The wire is physically detached from each of the bomblets but, as best illustrated in FIG. 6, actually passes through openings in each of the bomblets to ensure that the wire is maintained in a desired position relative to the bomblets. Wire 12 is of any suitable form capable of transmitting appropriate signals to the bomblets and of being withdrawn from the bomblets as described hereinafter; in the particular embodiment illustrated the wire is formed from 22–24 gage stranded copper wire with a Teflon coating.

A very long, continuous wire 12 may be used for each of the bomblet stacks, with the wire running longitudinally down the bomb from stack to stack and wound back and forth through the bomblets of each stack, or a bundle of wires may be employed with one wire used for each stack. The latter approach is used in the embodiment of FIG. 2; wire 12 is taken at the top of the bomblet stack from a bundle of wires 14 extending from a common signal generator, and at the bottom of the stack is returned to a bundle of wires 16 which return to the signal generator. Each of the wires in bundles 14 and 16 is wound in serpentine fashion through a respective stack of bomblets. Since each wire in the bundle is connected to carry the same signals as the other wires in the bundle, the bundled arrangement shown in FIG. 2 is functionally equivalent to a single wire which extends through all of the bomblet stacks.

Transmission wire 12 is bonded to the bomb canister 2 at selected spaced locations 18. In between the bonding locations a mechanism is provided external to the dunnage bag to break the wire when the canister opens and releases the bomblets. This allows the separating halves of the bomb canister to easily pull the severed wire sections away from the bomblets, permitting the bomblets to fall in a desired disperion pattern and at the same time avoiding the application of any significant wire separation forces that might distort the dispersion pattern. While various cutting devices, such as mechanical shears, could be used, linear shaped detonating charges 20 which run along the inside of the canister from stack to stack have provided the best results. The shaped charges are preferably glued into slots cut into the dunnage.

The disposition of the transmission wires 12 and shaped charges 20 along the inside of the bomb canister is illustrated in FIG. 3, in which the bomblets are obscured by dunnage bag 8. The exposed portions of the transmission wire 12 are the loops which extend out of the dunnage bag at the end of a row of bomblets and then re-enter the bag at another row of bomblets. The shaped charges 20 extend longitudinally along the length of the bomb, with one shaped charge positioned adjacent each series of transmission wire loops. The shaped charges are controlled by a detonator 22, which causes them to detonate and sever the transmission wire at the moment the bomb canister begins to separate.

The shaped charge, shown in detail in FIG. 4, preferably comprises a chevron-shaped casing 26 which is extruded from aluminum or lead, filled with an explosive 24, and directs the blast force of the charge. Casing 26, which preferably has an angle of about 120°, is angularly positioned with its legs against the transmission wire, directing the blast from the detonator cord toward the adjacent wall of the bomb canister 2 and generally away from the bomblets, and thus preventing damage to the bomblets. Upon detonation the aluminum or lead casing forms a plasma jet which severs the transmission wire. A satisfactory shaped charge is provided by the Ensign Bickford Company under model number FLSC C-IV, seven grain per foot lead sheath.

The individual bomblets are similar in design, and are illustrated in FIGS. 5 and 6. Each bomblet has an outer shell 28, the rear portion of which encloses an explosive 30 which is set off by a detonator 32. At the rear of the bomblet is a set of fins 34 which stabilize the bomblet as it drops through the air. A rotating air vane assembly 35 causes the bomblet to be armed as it drops through the air, and closes a connection to an internal battery which powers a detonation timing mechanism, described in greater detail hereinafter.

A nose section 36 projects from the forward end of the bomblet and is held onto the remainder of the bomblet by means of a retaining ring 38. An electrical circuit board 40 is mounted within the bomblet forward of the explosive section, with the timing control circuitry of the present invention carried on one side of the board and a battery 42 mounted on the opposite side. The forward section of the bomblet is separated from the explosive material by a bulkhead wall 44, with most of its interior filled by a potting compound 46. A set of wires 48 extends through the bulkhead wall to connect battery 42 with detonator 32, under the control of the timing circuitry.

Extending toward the bulkhead from one side of the printed circuit board 40 is a core 50, about which a multi-turn toroid 52 is wound. The interior of the core is open, permitting the transmission wire 12 to extend through the core opening 54 between aligned openings 55,56 in the bomblet shell. The transmission wire 12 extends through a channel 57 in the potting compound from one side of the bomblet to the other, and communicates with the electronics within the bomblet by serving as a single turn transformer primary winding. The toroid 52 forms a secondary winding which is electromagnetically coupled with the primary winding wire 12. The toroid 52 preferably has about 300 turns, thus establishing a 1:300 turns ratio for the transformer. The toroid wire is connected to the circuitry on the printed circuit board 40 and provides the means by which signals applied to the transmission wire 12 are delivered to the circuitry within each bomblet, without any mechanical connection between the wire 12 and the bomblets.

While an inductive transformer coupling mechanism is preferred, other means for electromagnetically coupling a remote transmission facility with control circuitry within each of the bomblets might be used, such as capacitive or radio frequency coupling mechanisms. The advantage of an inductive coupling is that it is a relatively inexpensive, compact and efficient means for both transmitting information signals and transferring power to the bomblets. The power requirements of the present system are in the order of tens of milliwatts per bomblet, both during programming and after programming but before bomb release. The use of capacitive coupling, especially at the approximately 20–30 KHz frequency ranges envisioned for the data transmission employed in the invention, would require large surface areas to obtain the same efficiency over equivalent distances. Capacitive coupling would be more suitable at higher frequencies, in the megahertz range. With an efficiency of approximately 90% at a distance of about one-half inch, inductive coupling is superior within this range.

Figure 7:
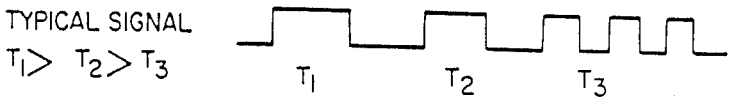
FIGS. 7 and 8 are diagrams of signal formats which can be used to communicate with the bomblets.
Figure 8:
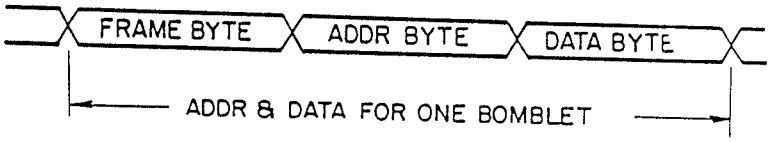

Two possible transmission signal formats for a transformer coupling mechanism are shown in FIGS. 7 and 8. Both approaches rely on frequency modulation to communicate from a single transmission wire 12 to the various bomblets. In both formats the signals applied are AC, or positive pulses followed by equivalent negative pulses, to avoid saturating the transformer. The system illustrated in FIG. 7 employs an unencoded frequency modulation in which a first signal T1 is transmitted along the transmission wire 12 to initially clear all the bomblets, a second signal T2 having a predetermined address code is then transmitted to access a particular bomblet, and finally an information signal T3 is transmitted to program the timing mechanism within the accessed bomblet so that the bomblet detonates at the programmed time delay after release from the cluster bomb canister.

In the preferred approach, each of the bomblets are provided with individual address codes in advance. A T1 signal is transmitted to pull the address code stored in each bomblet into the operating circuitry for that bomblet, and to clear the timer within each bomblet. The T1 signal consists of a relatively long, positive pulse followed by a negative pulse of equal duration. The T1 signal is followed by the T2 signal, which also consists of a positive pulse followed by a negative pulse, but which is considerably shorter than the T1 signal. The T2 signal performs an addressing function, causing the addresses stored within each of the bomblets to be advanced, and enabling the bomblet or bomblets whose address has just advanced to a predetermined code to be programmed with a desired detonation time delay by a T3 signal. The T3 signal immediately follows the T2 signal, and consists of a series of alternating positive and negative, short duration pulses. The particular bomblet then being accessed is set to a delay time which corresponds to the number of pulses in the T3 signal.

Following the T3 signal, another T2 signal is applied to again advance the addresses stored in the various bomblets. A new bomblet or bomblets is thus advanced to the predetermined address, and is programmed by a new T3 detonation delay signal following the T2 signal. The alternation of T2 and T3 signals continues until each of the bomblets has been programmed with an individual detonation delay time. In this manner, by adjusting the duration of the T3 signals as the bomblet programming progresses, each bomblet can be given a different detonation time delay. The T3 signals are preferably at a frequency of about 30 KHz, with each cycle programming the bomblet timer for a one second delay. In this manner, a cluster bomb with approximately 250 bomblets can be programmed in a total of about five minutes so that the bomblets will detonate at programmed intervals over a long period of time.

In the alternate programming approach illustrated in FIG. 8, each bomblet is provided with a permanent address that is not adjusted as programming progresses. Each bomblet is accessed by a different frequency modulated address code that is specific for that bomblet, and the time delay information is provided in the form of encoded frequency modulated signals, rather than of a variable duration, fixed frequency signal. In this system a frame byte is initially transmitted to indicate that a new bomblet is to be programmed. This is followed by an address byte, the frequency of which is varied from frame to frame in order to access a different bomblet with each frame. The address byte is followed by a data byte, the frequency of which is encoded in accordance with a schedule of possible delay times to program the accessed bomblet with the delay corresponding to the frequency of the particular data byte. While a generally higher data transfer rate, the unencoded system of FIG. 7 is simpler and is more compatible with the preferred transformer coupling apparatus.

Figure 9:
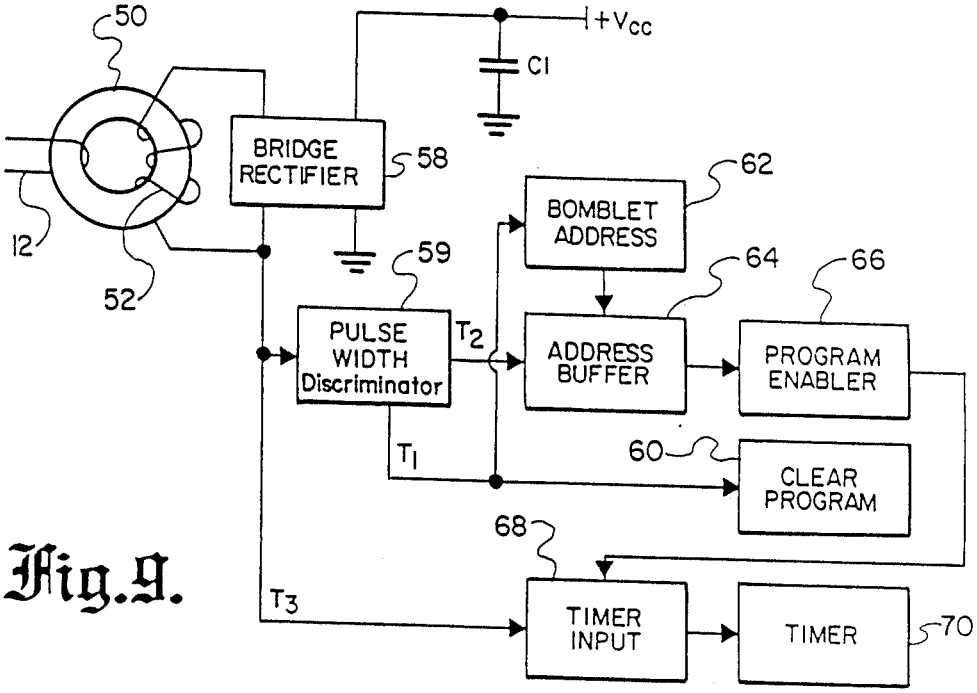
FIG. 9 is a partial block diagram of the detonation control system for each bomblet.
Figure 11:
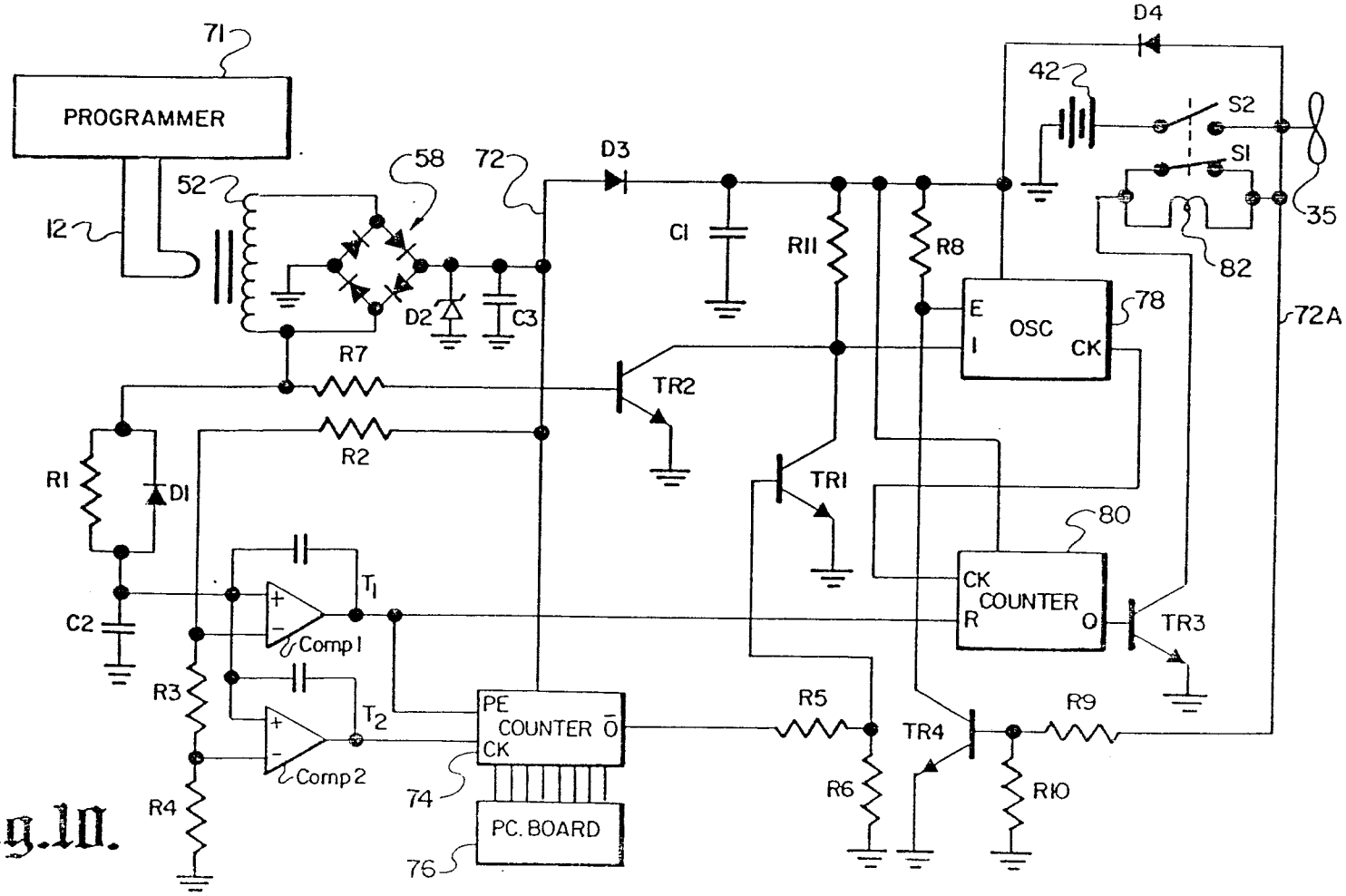

Turning now to FIG. 9, a block diagram of the detonation control circuitry within each of the bomblets is shown. Transmission wire 12 is shown as the primary winding of a transformer having toroid 52 as its secondary winding, and mandrel core 50 coupling the two windings. The output of winding 52 is applied to a bridge rectifier circuit 58 which provides a power source for the remaining circuitry. The bridge rectifier supplies a positive voltage bus Vcc, and also charges a holding capacitor C1 which continues the power supply during the time interval after transmission wire 12 has been pulled away from the bomblet, and before the bomblet's internal battery is connected to the circuitry.

One side of secondary winding 52 is connected to a pulse width discriminator circuit 59, which discriminates between T1 and T2 pulses. A T1 pulse is routed by the discriminator circuit to a clear program function 60 to clear any preset delay time from the timer, and is also routed to a permanent bomblet address storage device 62 to cause the address to be dumped into an address buffer 64.

A T2 pulse is routed by the discriminator circuit to address buffer 64, causing it to incrementally advance the address which it holds so that, after a sufficient number of T2 pulses, the address held in the buffer will reach a predetermined level. At this point the address buffer transmits a signal to a program enabler 66.

Each T3 signal following a T2 signal is routed directly to a timer input circuit 68. However, the T3 signal is prevented from programming the timer 70 until the program enabler 66 has been activated. At this point the timer input is enabled, allowing the next T3 signal to be applied to timer 70 and program a desired detonation delay time. At the next T2 signal the address stored in buffer 64 is again advanced, disabling program enabler 66 and preventing the timer 70 from receiving a different program.

A schematic diagram of the bomblet circuitry is shown in FIG. 10. A programming signal generator 71, which generates the T1, T2 and T3 signals and is located outside of the cluster bomb, is coupled by a suitable bushing device to apply appropriate signals to transmission wire 12. An RC circuit consisting of series connected resistor R1 and capacitor C2 is connected to one terminal of secondary transformer winding 52. The values of R1 and C2 are selected so that C2 will be charged to different voltage levels for T1, T2 and T3 signals, as determined by the duration of the pulses associated with those signals. Since in the signal format illustrated in FIG. 7 the T1 pulse is of greatest duration, C2 will charge to the highest voltage level during that pulse. It will charge to the progressively lower voltage levels for T2 and T3 pulses, which are of progressively shorter duration. A diode D1 is connected in parallel with R1 to rapidly discharge C2 during the negative pulse following each positive pulse, thus assuring that C2 does not retain any memory of past pulses.

C2 is connected to bias the positive input to each of a pair of comparators COMP1 and COMP2. The negative inputs to COMP1 and COMP2 are connected to a voltage divider resistor network comprising resistors R2, R3 and R4. These resistors connected in series between the positive voltage bus 72 supplied by bridge rectifier 58, and ground. The COMP1 input is connected to the junction between R2 and R3 while the COMP2 input is connected to the junctions between R3 and R4, thus maintaining the COMP1 negative input at a higher voltage than the negative input to COMP2.

The comparator circuits together with C2, R1, D1 and the voltage divider function as pulse width discriminator circuit 59 of FIG. 9. The component values are selected such that both COMP1 and COMP2 produce positive outputs when a T1 pulse is present on transmission wire 12. However, the duration of a T2 signal on wire 12 is short enough so that C2 charges to a level sufficient to gate COMP2 but not COMP1. Thus, both comparators will produce an output during T1, but only COMP2 will produce an output during T2. The T3 pulses are short enough so that neither comparator will produce an output during T3.

The output of COMP1 is connected to the program enable input of an eight bit counter 74, which provides the address buffer function 64 illustrated in FIG. 9, while the output of COMP2 is connected to the counter's clock input. Counter 74 is connected to a hard wired printed circuit board 76, which is provided with an eight bit permanent address code. Counter 74 is configured so that a T1 signal at its program enable input causes the address code stored in printed circuit board 76 to be transferred to the counter, where it is stored in counter 74 as an eight bit binary number. Each appearance of a T2 signal at the counter lock input causes the address code stored in counter 74 to shift down by one binary increment.

Counter 74 has an inverted output which is connected through a voltage divider circuit consisting of resistors R5 and R6 to the base of an npn bipolar transistor TR1. At all times except when counter 74 has reached a predetermined binary address code number, such as zero, the counter output is at a high level, biasing TR1 into conduction. When counter 74 reaches the predetermined number, its output goes low and turns TR1 off. TR1 provides the function of program enabler 66 of FIG. 9, permitting the bomblet timer to be programmed only when it has been turned off.

The output terminal of secondary transformer winding 52 is also connected through a resistor R7 to the base of another npn bipolar transistor TR2, the emitter of which is grounded and the collector output of which is connected to the input terminal of an oscillator 78. The clock output from the oscillator is connected to the clock input of a counter 80. This counter also receives an input to its reset terminal from COMP1, which furnishes a reset signal to the counter in response to a T1 transmission. The output of counter 80 is connected to gate a transistor switch TR3, the collector output of which is connected to a detonator coil 82 which controls the detonation of the explosive within the bomblet. Detonator coil 82 is normally short-circuited by one pole S1 of a double pole switch. The opposite end of the detonator coil is connected to a secondary voltage supply bus 72A.

The other switch pole S2, which is normally open, connects internal battery 42 to the positive voltage bus. The switch is operated by rotation of the bomblet air vane 35 34, which act as a turbine.

The operation of oscillator 78 is controlled by a circuit connected to its enable input, the circuit comprising a resistor R8 connected between the positive voltage bus 72 and the enable input, and a switch transistor TR4 with its collector connected to the enable input and its emitter grounded. TR4 is biased from the secondary positive voltage bus 72A through a voltage divider circuit consisting of series connected resistors R9 and R10, the base of TR4 being connected to the junction between the resistors. The input terminal to oscillator 78 is controlled by a similar circuit, consisting of resistor R11 connected between positive voltage bus 72 and the oscillator's input terminal, and transistors TR1 and TR2 connected between the input terminal and ground, as previously described.

The power supply for the bomblet circuitry is provided from one output terminal of bridge rectifier circuit 58, the other output terminal being grounded. A zener diode D2 is connected between ground and the voltage supply bus 72 to clamp the voltage at the output of the bridge circuit, and a filter capacitor C3 is also connected to the voltage supply bus to filter out transients. Connections are made to the voltage supply bus 72 to power the voltage divider circuit associated with the comparator circuits, address counter 74, oscillator 78, counter 80, and their associated switch control circuits. Holding capacitor C1 is connected to be charged by the supply bus 72 prior to release of the bomblet from the cluster bomb canister. Since the address counter 74 draws power from the voltage supply from the time the address stored in printed circuit board 76 has been loaded into the counter, a diode D3 is connected in the supply bus 72 between holding capacitor C1 and the connection to address counter 74 to prevent the counter from drawing power after the bomblet has been released and the transformer has been disconnected from an external power source. Another diode D4 between voltage supply bus 72 and secondary supply bus 72A is oriented to assure that no power is supplied to the detonator coil 82 before the bomblet has been released, but permits oscillator 78 and counter 80 to be powered by battery 42 after release.

In operation, the bomblet is initially connected to external programmer 71, which operates through the transformer and bridge rectifier circuit to bring the power supply circuitry up to the desired voltage level. At this time, before any T1, T2 or T3 signals have been applied, the inverted output from address counter 74 is high, closing switch transistor TR1 and thus shorting the input terminal to oscillator 78 to prevent it from receiving any input signals. Switch transistor TR4 is open, keeping the enable input to oscillator 78 at a high voltage and preventing the oscillator from running. Switch S1 is closed, short-circuiting the detonator coil 82, while switch S2 is open, disconnecting power supply battery 42 from the remainder of the circuit. During this time the power supply signal applied to transmission wire 12 is preferably at the T3 frequency.

The programming cycle begins when a T1 signal is applied to transmission wire 12. This relatively long pulse charges capacitor C2 up to a voltage sufficient to cause COMP1 to produce an output. The T1 signal at the output of COMP1 causes address counter 74 to load in the address permanently stored on printed circuit board 76, and also reset timer counter 80 to 0. Next, a T2 pulse is applied along transmission wire 12. This pulse is short enough so that only COMP2 is gated, causing a T2 pulse to be applied to the clock input of address counter 74 to advance the counter downward by one binary increment. Assuming the original address received by the counter is greater than 1, this advancement of the binary count will not change the output of counter 74, which will remain high and continue to cause switch transistor TR1 to short out the input to oscillator 78.

Each pulse of the T3 signal following the T2 signal is short enough so that neither COMP1 nor COMP2 is gated. The T3 signal is applied to the base of switch transistor TR2, and exercises the switch by alternately opening and closing it at the T3 frequency. However, since the input to oscillator 78 is grounded by TR1, this exercising of TR2 has no effect on the oscillator.

Following the T3 signal another T2 signal is applied, causing address counter 74 to advance down by another binary increment. This is followed by another T3 series, which again will be unable to program the bomblet timing mechanism if the address counter 74 has not yet reached a zero count.

Alternate T2 and T3 signals continue to be applied, their only effect on the bomblet being to progressively advance the count held by address counter 74 towards a zero level. When a T2 signal is applied which does cause address counter 74 to reach zero, the counter's inverted output signal goes low, opening TR1. At this point, the oscillator input terminal is still grounded by TR2. However, when the next T3 signal arrives, TR2 is alternately opened and closed at the T3 frequency of 30 KHz, and thus causes positive voltage pulses to be applied to the oscillator input terminal at this rate. Each time the oscillator receives an input pulse it produces a clock output pulse which is transmitted to the clock input of timer counter 80, causing the counter to count up by one binary digit for each pulse. At the 30 KHz rate, counter 80 can reach a count of 86,400 in less than three seconds. This is significant because, when the counter is later caused to count down at a rate of one count per second after the bomblet has been dropped, an initial count of 86,400 will produce a twenty-four hour count down period.

Timer counter 80 is counted up to a number corresponding to the number of pulses in the T3 signal, and thus acquires a time delay program. Following this programming step another T2 signal is applied. This signal advances address counter 74 by one more increment, causing its output to return to a high voltage level to close TR1 and again short-circuit the input to oscillator 78. The oscillator is thus effectively isolated from the following T3 signal, and timer counter 80 retains the count it received during the previous T3 signal. In this manner, by providing each separate bomblet with a different initial address, each of the bomblets in turn can be programmed with a unique T3 delay signal. Although all of the bomblets will receive each T3 signal, only the one bomblet (or more if desired) whose T1 transistor is open at the time will respond to each T3 signal. By adjusting the T3 signals from bomblet to bomblet, each bomblet can thus be programmed with a different detonation time delay, such that they will detonate in any desired sequence over a given period of time.

When the cluster bomb is dropped and opens to release the bomblets, the bomblets' air vane 35 begins to rotate. This causes switch S1 to open and thus arm the detonator, and also causes swtich S2 to close and connect internal battery 46 to the power supply bus. It takes about 1.5 seconds from the separation of the bomb canister for the bomblets to arm and be powered by their internal batteries; during this period holding capacitor C1 provides power to oscillator 78 and counter 80. The closing of switch S2 causes a voltage to be applied from battery 42 to the base of timer control transistor TR4, gating the transistor and causing it to remove the disable signal from oscillator 78. This enables the oscillator to begin normal operations, producing a clock output pulse at the internal oscillator rate of one pulse per second. Each pulse causes counter 80 to count down from its original stored number at the rate of one count per second. By using the internal oscillation rate of oscillator 78 to slowly count down the delay period but operating oscillator 78 under the control of TR2 to rapidly count up the delay period, the requirement for a separate oscillator associated with TR2 is eliminated, thus saving expense and circuit board area.

Counter 80 continues to count down under the control of oscillator 78 at the rate of one count per second, until it reaches zero. At this time it produces a positive output to gate transistor switch TR3 into conduction, thus completing a circuit between battery 42, detonation coil 82 and ground, and causing the bomblet to explode.

While particular embodiments of the invention have been shown and described, various modifications and alternate embodiments will occur to those skilled in the art. Accordingly, it is intended that the invention be limited only in terms of the appended claims.

We claim:

1. In a cluster bomblet having a detonating mechanism and a transformer secondary winding for receiving bomblet address and detonation delay signals from a primary winding which is external to the bomblet and is pulled away when the bomblet is released, the improvement comprising a detonator control circuit which comprises:

an address storage means having an adjustable bomblet address stored therein, a programmable timing means connected to actuate the detonating mechanism after a programmed time delay, a signal discriminator circuit connected to recognize bomblet address signals at the secondary winding, means connecting the secondary winding to the timing means to transmit a detonator delay program signal to the timing means, means connecting the discriminator circuit to the address storage means to adjust the address stored therein in response to the discriminator circuit receiving a bomblet address signal, and an enabling circuit connected to enable programming of the timing means by a detonation delay signal in response to the address stored in the address storage means being adjusted to a predetermined address, and to disable programming of the timing means at other times.

2. The cluster bomblet of claim 1, said address storage means comprising a permanent storage means and a buffer storage means, said permanent storage means being supplied with a permanent address, said buffer storage means connected to the permanent storage means to receive the permanent address therefrom, the address stored in the buffer storage means being adjustable in response to the discriminator circuit receiving a bomblet address signal.

3. The cluster bomblet of claim 2, said discriminator circuit further including means to discriminate between an initiation signal received from the secondary winding and bomblet address and detonation delay signals, and an initiation circuit connected to initiate a transfer of the permanent address from the permanent storage means into the buffer storage means in response to the discriminator circuit receiving an initiation signal.

4. The cluster bomblet of claim 3, said initiation circuit being further connected to clear the programmable timing means in response to the discriminator circuit receiving an initiation signal.

5. The cluster bomblet of claim 3, said initiation, bomblet address and detonation delay signals comprising pulse signals of mutually exclusive durations, said signal discriminator circuit comprising a pulse width discriminator circuit.

6. The cluster bomblet of claim 1, said bomblet address and detonation delay signals comprising pulse signals of mutually exclusive durations, said signal discriminator circuit comprising a pulse width discriminator circuit.

7. The cluster bomblet of claim 1, said timing means comprising a counter connected to count up to a number determined by the duration of the detonation delay signal, an oscillator connected to cause the counter to progressively count down at a predetermined rate, means for actuating the detonating mechanism when the counter has counted down to a predetermined number, and means responsive to the bomblet entering a drop sequence for actuating the oscillatorcontrolled count down.

8. The cluster bomblet of claim 7, said detonation delay signal comprising an alternating signal having a predetermined frequency, said means connecting the secondary winding to the timing means including a switch connected to be exercised at a predetermined rate by a detonation delay signal on the secondary winding, said switch providing an output connected to cause the counter to count up at a rate corresponding to the switch exercise rate.

9. The cluster bomblet of claim 8, said oscillator being connected between the switch output and the counter, and causing the counter to count up at a rate corresponding to the switch exercise rate.

10. The cluster bomblet of claim 1, further comprising a rectifier circuit connected to the secondary winding to supply power from the transformer primary winding to the detonator control circuit.

11. The cluster bomblet of claim 10, further comprising a battery within the bomblet, a switch operable to connect the battery to supply power to the timing means, and means responsive to the bomblet entering a drop sequence for operating the switch.

12. The cluster bomblet of claim 1, further comprising a capacitor circuit connected to be charged by said rectifier circuit and to supply power to the timing means during the interval between the primary winding being pulled away from the bomblet and the operation of the battery switch.

13. In a cluster bomblet having a detonating mechanism, and a transformer secondary winding for receiving pulsed initiation, bomblet address and detonation delay signals of mutually exclusive pulse widths from a primary winding which is external to the bomblet and is pulled away when the bomblet is released, the improvement comprising a detonator control circuit which comprises:

a permanent address storage means supplied with a permanent bomblet address, a buffer address storage means which is connected to the permanent storage means to receive the permanent address stored therein, a pulse width discriminator circuit having first and second outputs and connected to discriminate between initiation, bomblet address and detonation delay signals at the secondary winding, the first output being connected to initiate a transfer of the permanent bomblet address into the buffer storage means in response to an initiation signal, and the second output being connected to progressively advance the address held in the buffer storage means in response to each bomblet address signal, a counter connected to actuate the detonating mechanism when the counter has counted down to a predetermined number, an oscillator connected to cause the counter to count down at a predetermined rate, a first switch means connected to the secondary winding and having an output connected in circuit with the counter, said first switch means adapted to be oscillated by a detonation delay signal on the secondary winding and to cause the counter to count up to a level corresponding to the duration of the detonation delay signal, and a second switch means connected in a circuit to enable the counter to count up under the control of a detonation delay signal on the secondary winding, said second switch means being controlled by the buffer storage means to enable the counter only when the buffer storage means is storing a predetermined address, whereby the bomblet may be programmed with an individual detonation delay in coordination with other bomblets supplied by the same primary winding by providing the respective bomblets with progressively advanced permanent addresses, and progressively advancing the address held in the buffer storage for each bomblet by successive address signals, so that each bomblet in turn can be programmed by respective detonation delay signals alternating with the address signals.

14. The cluster bomblet of claim 13, the first pulse width discriminator output also being connected to clear the counter in response to an initiation signal.

15. The cluster bomblet of claim 13, said pulse width discriminator circuit comprising first and second comparators respectively providing said first and second outputs, a bias circuit setting a first input to the first comparator at one voltage level and a first input to the second comparator at a second voltage level which is different from the first level, and an RC charging circuit connected to the secondary winding to charge up to a voltage level corresponding to the duration of a pulse on said winding, said RC charging circuit being connected to apply said voltage level to the second inputs to each comparator.

16. The cluster bomblet of claim 15, the RC and bias circuits being designed so that the first and second comparators each produce an output in response to an initiation signal on the secondary winding, and only the second comparator produces an output in response to an address signal on the secondary winding.

17. The cluster bomblet of claim 16, the RC and bias circuits being designed so that neither comparator produces an output in response to a detonation delay signal on the secondary winding.

18. The cluster bomblet of claim 13, said oscillator being connected between the output of the first switch means and the counter and controlling the counter to count up at a rate corresponding to the oscillation rate of the detonation delay signal.

19. The cluster bomblet of claim 13, further comprising a bridge rectifier circuit connected to the secondary winding to supply power from the transformer primary winding to the detonator control circuit.

20. The cluster bomblet of claim 19, further comprising a battery within the bomblet, a switch operable to connect the battery to supply power to the oscillator and counter, and means responsive to the bomblet entering a drop sequence for operating the switch.

21. The cluster bomblet of claim 20, further comprising a capacitor circuit connected to be charged by said bridge rectifier circuit and to supply power to the oscillator and counter during the interval between the primary winding being pulled away from the bomblet and the operation of the battery switch.

* * * * *